US010478042B2

(12) United States Patent
Fawaz

(10) Patent No.: US 10,478,042 B2
(45) Date of Patent: Nov. 19, 2019

(54) BASKETS FOR USE IN A DISHWASHER APPLIANCE

(71) Applicant: Haier US Appliance Solutions, Inc., Wilmington, DE (US)

(72) Inventor: Bassam Fawaz, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 288 days.

(21) Appl. No.: 15/450,181

(22) Filed: Mar. 6, 2017

(65) Prior Publication Data

US 2018/0249885 A1 Sep. 6, 2018

(51) Int. Cl.

| | |
|---|---|
| ***A47L 15/50*** | (2006.01) |
| ***A47L 15/42*** | (2006.01) |
| ***A47L 15/23*** | (2006.01) |
| ***A47L 15/16*** | (2006.01) |

(52) U.S. Cl.

CPC ..... *A47L 15/502* (2013.01); *A47L 15/16* (2013.01); *A47L 15/23* (2013.01); *A47L 15/4225* (2013.01); *A47L 15/507* (2013.01); *A47L 15/508* (2013.01)

(58) Field of Classification Search

CPC ..... A47L 15/50

See application file for complete search history.

(56) References Cited

U.S. PATENT DOCUMENTS

| | | | | |
|---|---|---|---|---|
| 3,732,876 | A | 5/1973 | Braga et al. | |
| 5,431,294 | A * | 7/1995 | Stottmann | A47L 15/502 211/181.1 |
| 5,816,273 | A | 10/1998 | Milocco et al. | |
| 7,523,758 | B2 | 4/2009 | Vanderroest et al. | |
| 9,259,138 | B2 | 2/2016 | Chen et al. | |
| 9,301,670 | B2 | 4/2016 | Dalsing et al. | |
| 9,782,787 | B2 * | 10/2017 | Beijbom | B08B 3/02 |
| 2010/0101611 | A1 | 4/2010 | Chen et al. | |
| 2012/0167927 | A1 | 7/2012 | Shin et al. | |

FOREIGN PATENT DOCUMENTS

| | | | |
|---|---|---|---|
| CN | 202446041 | U | 9/2012 |
| EP | 1776916 | A1 * | 4/2007 |
| EP | 1776916 | B1 | 1/2009 |

* cited by examiner

*Primary Examiner* — Michael E Barr
*Assistant Examiner* — Jason P Riggleman
(74) *Attorney, Agent, or Firm* — Dority & Manning, P. A.

(57) ABSTRACT

A dishwasher appliance includes a tub defining a wash chamber. The dishwasher appliance also includes a rack assembly disposed within the wash chamber. The rack assembly may define a wash compartment. In addition, the dishwasher appliance may include a basket disposed within the wash compartment. The basket may comprise a magnet, and the basket may be removably mounted to the rack assembly via the magnet.

3 Claims, 12 Drawing Sheets

BASKETS FOR USE IN A DISHWASHER APPLIANCE

FIELD OF THE INVENTION

The present subject matter relates generally to dishwasher appliances and more particularly to baskets for use within dishwasher appliances.

BACKGROUND OF THE INVENTION

Dishwasher appliances generally include a tub that defines a wash chamber. Certain dishwasher appliances also include a rack assembly mounted within the wash chamber. A user can load articles, such as plates, bowls, glasses, and/or cups, into the rack assembly, and the rack assembly can support such articles within the wash chamber during operation of the dishwasher appliance.

Certain rack assemblies may support a basket capable of storing kitchen utensils (e.g., silverware) during operation of the dishwasher appliance. While the basket is generally secured within the rack assembly, the basket may move due to various forces acting on the basket. This movement can be problematic, because the basket, or its contents, may damage other articles (e.g., dishware) positioned within the rack assembly.

Additionally, placement of the basket within the wash chamber is generally confined to the rack assembly. As a result, rack assemblies must accommodate space for the basket. This is undesirable, because it limits the amount of space available for dishware items (e.g., plates, glasses, and bowls).

Accordingly, improved baskets for use in dishwasher appliances are desired. In particular, a basket that is less susceptible to movement within the rack assembly would be welcomed. Additionally, a basket that can be positioned at other locations within the wash chamber, not including the rack assembly, would be desired.

BRIEF DESCRIPTION OF THE INVENTION

Additional aspects and advantages of the invention will be set forth in part in the following description, or may be apparent from the description, or may be learned through practice of the invention.

In one embodiment, a dishwasher appliance includes a tub defining a wash chamber. The dishwasher appliance may also include a rack assembly disposed within the wash chamber. The rack assembly may define a wash compartment. In addition, the dishwasher appliance may include a basket disposed within the wash compartment. The basket may comprise a magnet, and the basket may be removably mounted to the rack assembly via the magnet.

In another embodiment, a dishwasher appliance includes a tub comprising a top wall, a bottom wall, and a plurality of side walls extending between the top and bottom walls. In addition, the tub may define a wash chamber. The dishwasher appliance may also include a basket disposed within the wash chamber. The basket may comprise a magnet, and the basket may be removably mounted to one of the plurality of sidewalls via the magnet.

In yet another embodiment, a dishwasher appliance includes a tub defining a wash chamber. The dishwasher appliance may also include a rack assembly disposed within the wash chamber. The rack assembly may define a wash compartment. In addition, the dishwasher appliance may include a basket comprising a magnet. The basket may be disposed within the wash compartment. The dishwasher appliance may also include a pump configured to deliver a wash fluid into the wash chamber. In addition, the dishwasher appliance may include a static jet assembly disposed within the wash chamber. The static jet assembly may comprise a static body positioned within the wash compartment. The static body may define an interior passage and a jet aperture in fluid communication with the pump. The jet aperture may be in fluid communication between the interior passage and the wash chamber. The basket may be removably mounted to the static body via the magnet.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
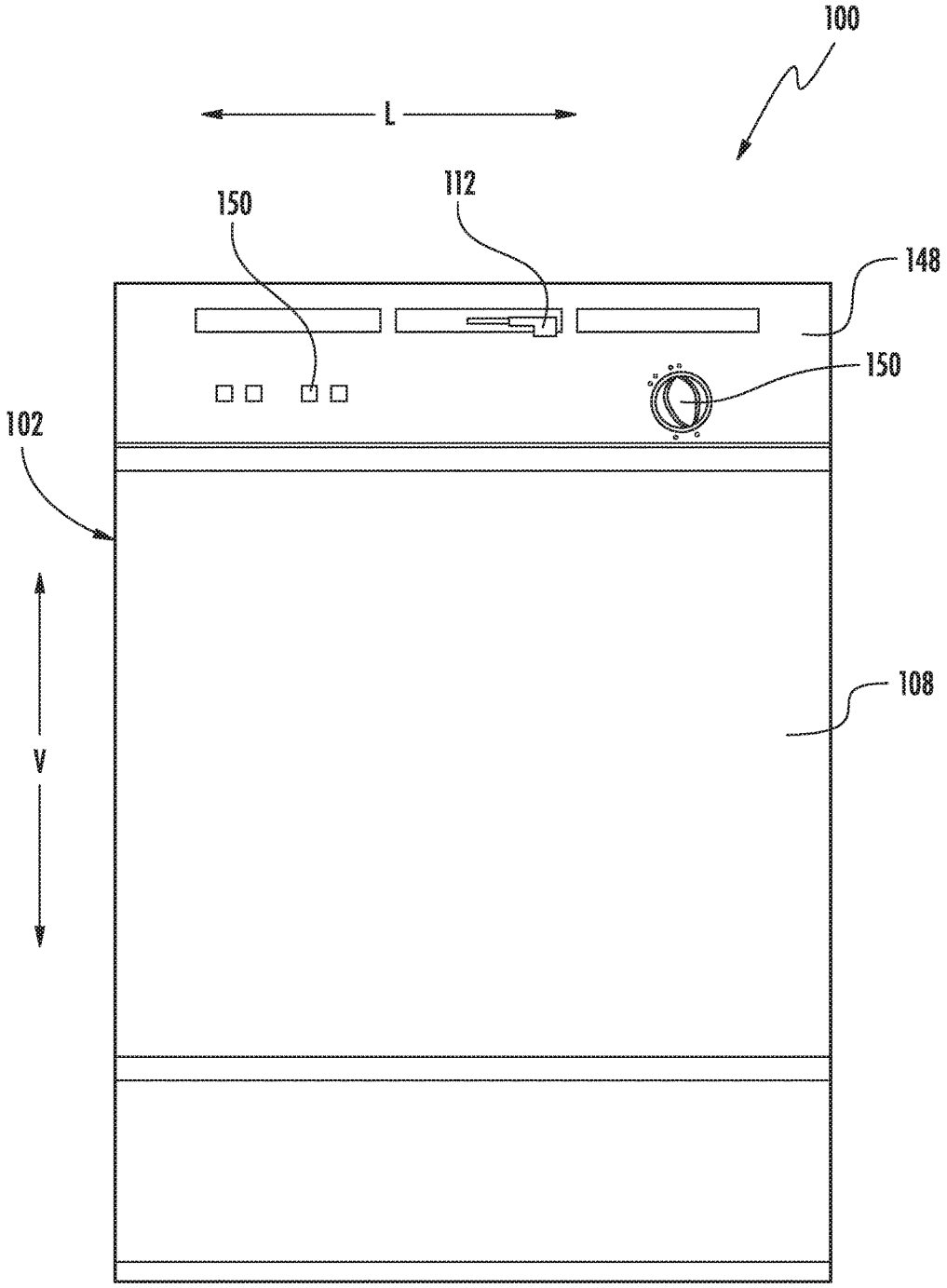
FIG. 1 provides a front view of a dishwasher appliance in accordance with embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
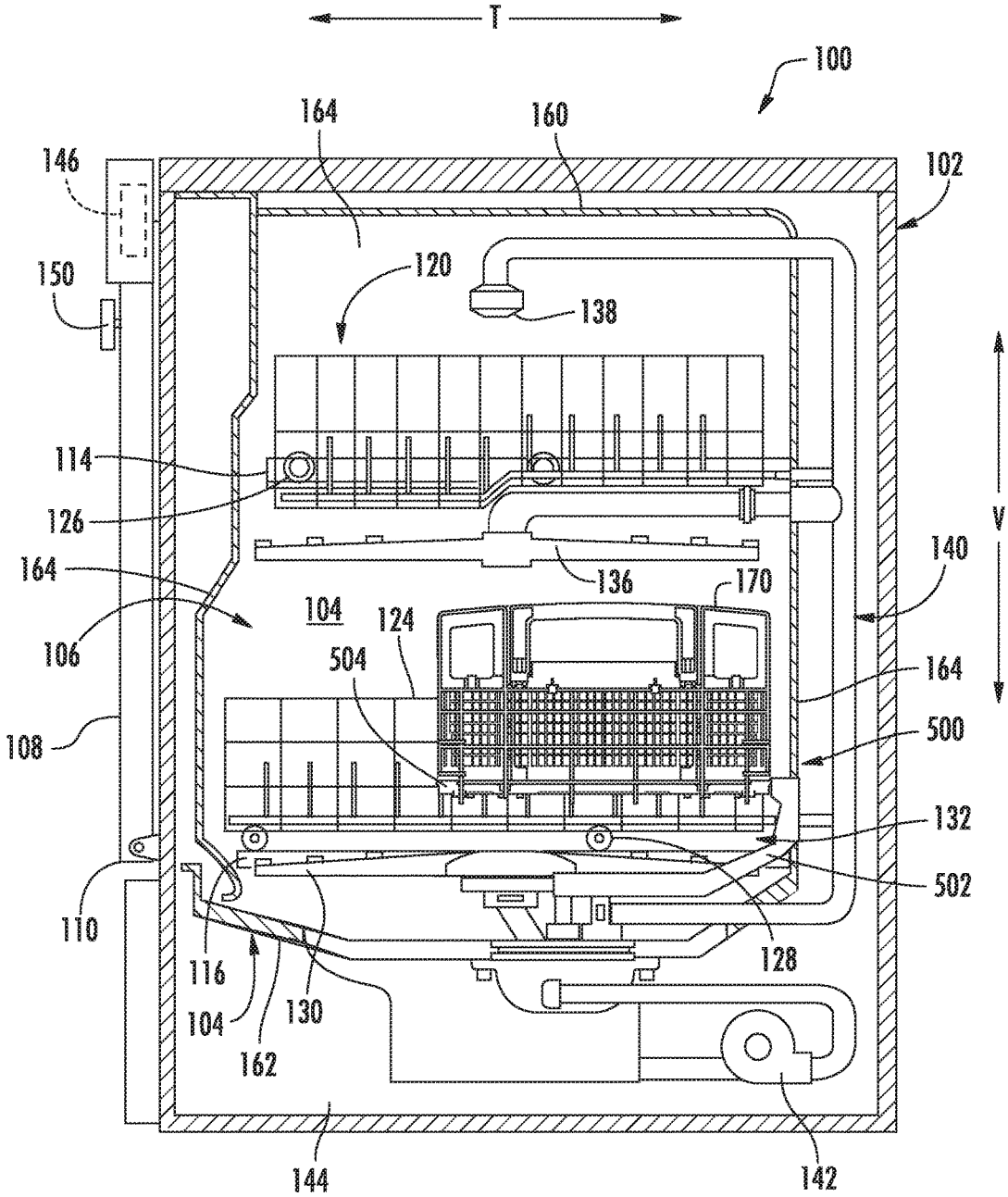
FIG. 2 provides a cross-sectional side view of a dishwasher appliance in accordance with embodiments of the present disclosure.

Referring now to the figures, FIGS. 1 and 2 illustrate one embodiment of a domestic dishwasher appliance 100 that may be configured in accordance with aspects of the present disclosure. As shown in FIGS. 1 and 2, the dishwasher appliance 100 may include a cabinet 102 having a tub 104 therein defining a wash chamber 106. The tub 104 may generally include a front opening (not shown) and a door 108 hinged at its bottom 110 for movement between a normally closed vertical position (shown in FIGS. 1 and 2), wherein the wash chamber 106 is sealed shut for washing operation, and a horizontal open position for loading and unloading of articles from the dishwasher. As shown in FIG. 1, a latch 112 may be used to lock and unlock the door 108 for access to the wash chamber 106.

The tub 104 may define a discrete vertical direction V, lateral direction L, and transverse direction T. Vertical direction V, lateral direction L, and transverse direction T are orthogonally oriented such that vertical direction V, lateral direction L, and transverse direction T form an orthogonal directional system.

As is understood, the tub 104 may generally have a rectangular cross-section defined by various wall panels or walls. For example, as shown in FIG. 2, the tub 104 may include a top wall 160 and a bottom wall 162 spaced apart from one another along a vertical direction V of the dishwasher appliance 100. Additionally, the tub 104 may include a plurality of sidewalls 164 (e.g., three sidewalls) extending between the top and bottom walls 160, 162. It should be appreciated that the tub 104 may generally be formed from any suitable material. However, in several embodiments, the tub 104 may be formed from a ferromagnetic material, such as stainless steel, or a polymeric material.

As shown in FIG. 2, upper and lower guide rails 114, 116 may be mounted on opposing sidewalls 164 of the tub 104 and may be configured to accommodate roller-equipped rack assemblies 120 and 122. Each of the rack assemblies 120, 122 may be fabricated into lattice structures including a plurality of elongated members 124 (for clarity of illustration, not all elongated members making up assemblies 120 and 122 are shown in FIG. 2). Additionally, each rack assembly 120, 122 may be adapted for movement between an extended loading position (not shown) in which the rack 120, 122 is substantially positioned outside the wash chamber 106, and a retracted position (shown in FIG. 2) in which the rack 120, 122 is located inside the wash chamber 106. This may be facilitated by rollers 126 and 128, for example, mounted onto racks 120 and 122, respectively.

In some embodiments, a basket 170 is removably mounted to lower rack assembly 122. However, in alternative exemplary embodiments, the basket 170 may also be selectively attached to other portions of dishwasher appliance 100, e.g., the upper rack assembly 120 or door 108. The basket 170 defines one or more storage chambers and is generally configured to receive of silverware, flatware, utensils, and the like, that are too small to be accommodated by the upper and lower rack assemblies 120, 122. The basket 170 may be constructed of any suitable material, e.g., metal or plastic, and define a plurality of apertures 178 for permitting a flow wash fluid or air therethrough.

The dishwasher appliance 100 includes one or more spray assemblies housed within the wash chamber 106. For instance, the dishwasher appliance 100 may include a lower spray-arm assembly 130 that is rotatably mounted within a lower region 132 of the wash chamber 106 directly above the bottom wall 162 of the tub 104 so as to rotate in relatively close proximity to the rack assembly 122. As shown in FIG. 2, a mid-level spray-arm assembly 136 may be located in an upper region of the wash chamber 106, such as by being located in close proximity to the upper rack 120. Moreover, an upper spray assembly 138 may be located above the upper rack 120.

As is generally understood, the lower and mid-level spray-arm assemblies 130, 136 and the upper spray assembly 138 may generally form part of a fluid circulation assembly 140 for circulating fluid (e.g., water and dishwasher fluid) within the tub 104. As shown in FIG. 2, the fluid circulation assembly 140 may also include a pump 142 located in a machinery compartment 144 located below the bottom wall 162 of the tub 104. One or all of the spray assemblies 130, 136, 138 may be in fluid communication with the pump 142, e.g., to receive a pressurized wash fluid therefrom. Additionally, each spray-arm assembly 130, 136 may include an arrangement of discharge ports or orifices for directing washing liquid onto dishes or other articles located in rack assemblies 120 and 122, which may provide a rotational force by virtue of washing fluid flowing through the discharge ports. The resultant rotation of the lower spray-arm assembly 130 provides coverage of dishes and other dishwasher contents with a spray, e.g., a spray of washing fluid.

The dishwasher appliance 100 may be further equipped with a controller 146 configured to regulate operation of the dishwasher 100. The controller 146 may generally include one or more memory devices and one or more microprocessors, such as one or more general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 146 may be positioned in a variety of locations throughout dishwasher appliance 100. In the illustrated embodiment, the controller 146 is located within a control panel area 148 of the door 108, as shown in FIG. 1. In such an embodiment, input/output ("I/O") signals may be routed between the control system and various operational components of dishwasher appliance 100 along wiring harnesses that may be routed through the bottom 110 of the door 108. Typically, the controller 146 includes a user interface panel/controls 150 through which a user may select various operational features and modes and monitor progress of the dishwasher 100. In one embodiment, the user interface 150 may represent a general purpose I/O ("GPIO") device or functional block. Additionally, the user interface 150 may include input components, such as one or more of a variety of electrical, mechanical or electro-mechanical input devices including rotary dials, push buttons, and touch pads. The user interface 150 may also include a display component, such as a digital or analog display device designed to provide operational feedback to a user. The user interface 150 may be in communication with the controller 146 via one or more signal lines or shared communication busses.

It should be appreciated that, although the dishwasher appliance 100 will generally be described herein as including three spray assemblies 130, 136, 138, the dishwasher appliance may, in alternative embodiments, include any other number of spray assemblies, including two spray assemblies, four spray assemblies or five or more spray assemblies. For instance, in addition to the lower and mid-level spray-arm assemblies 130, 136 and the upper spray assembly 138 (or as an alternative thereto), the dishwasher appliance 100 may include one or more other spray assemblies and/or wash zones for distributing fluid within the wash chamber 106.

Figure 3:
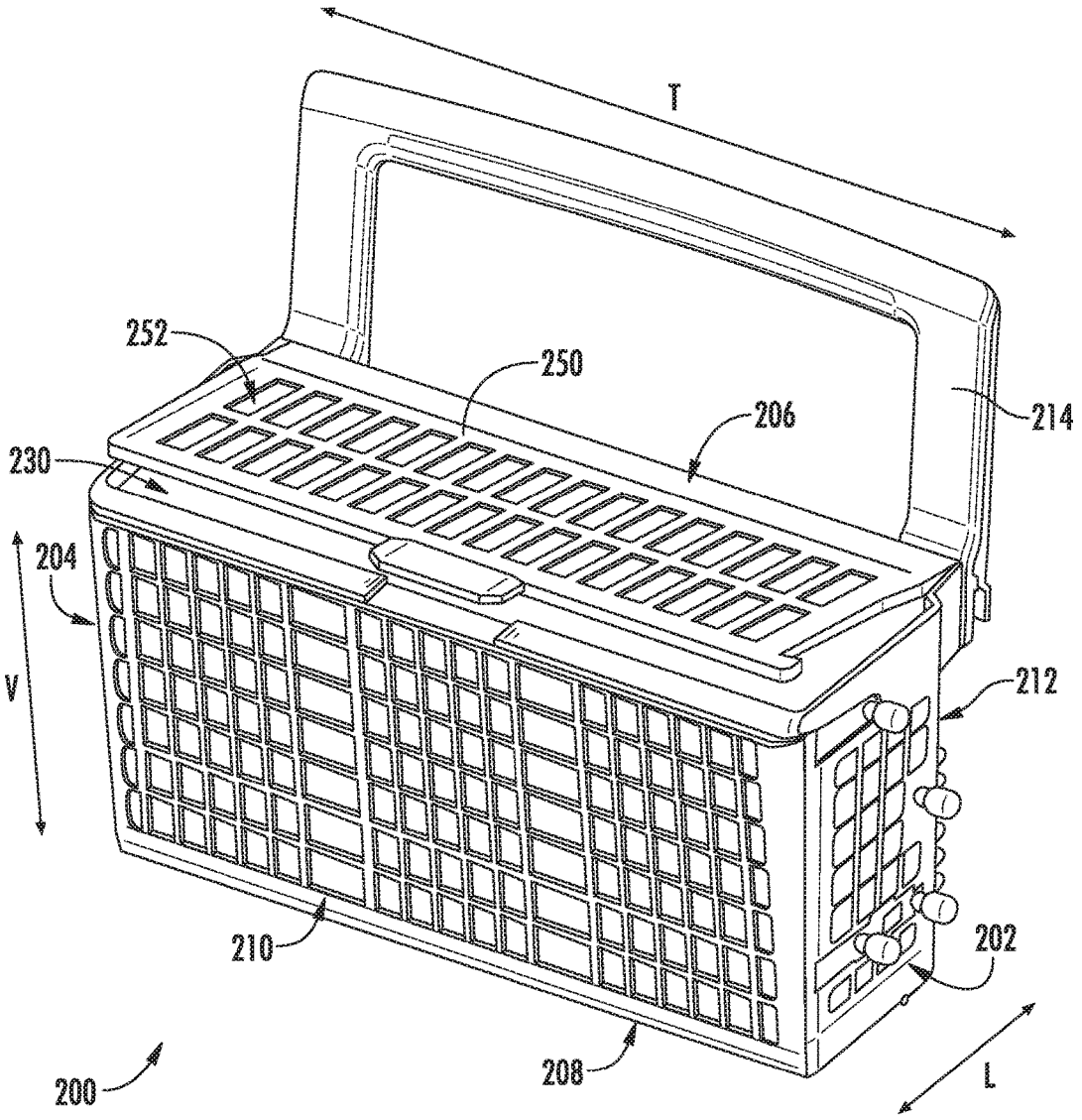
FIG. 3 provides a perspective view of a basket in accordance with embodiments of the present disclosure.
Figure 4:
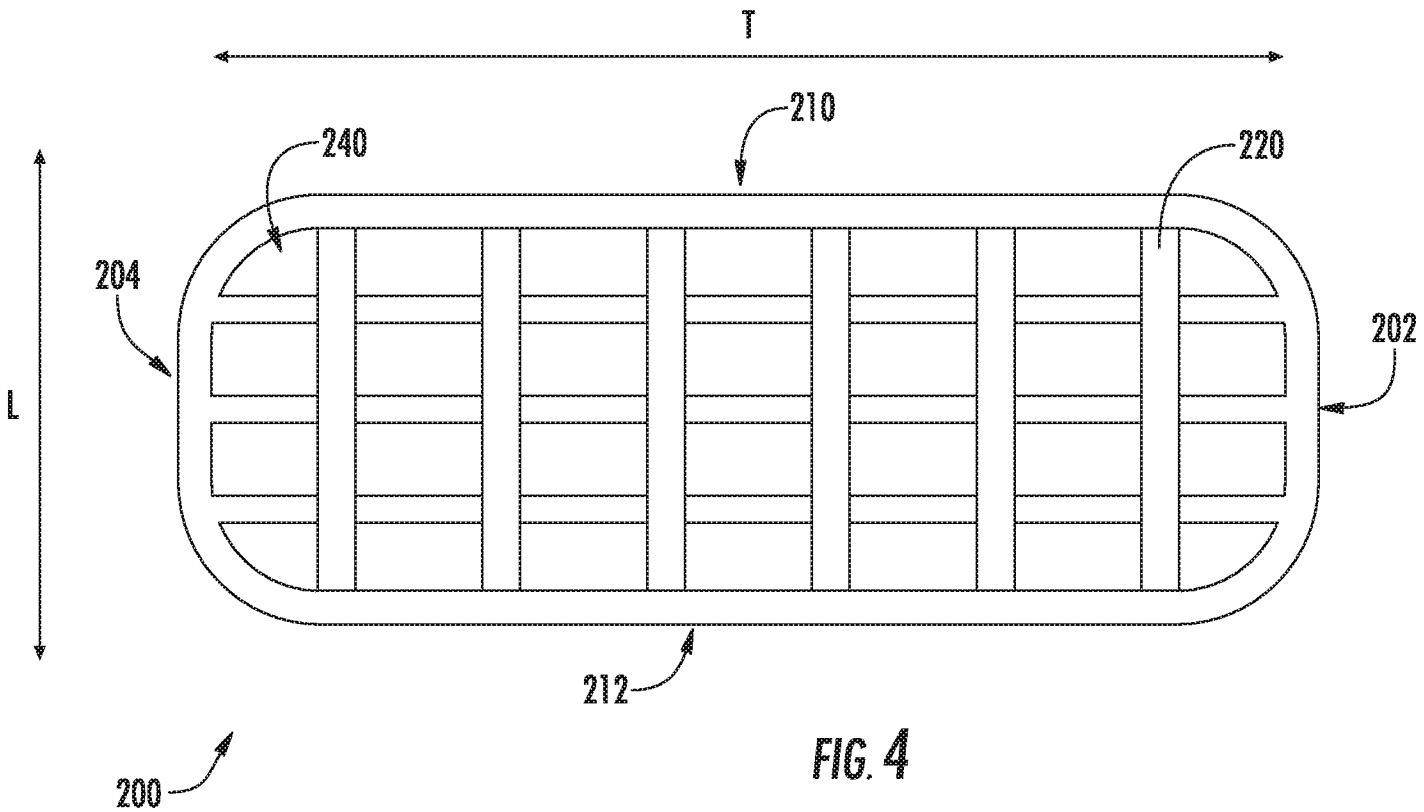
FIG. 4 provides a bottom view of a basket in accordance with embodiments of the present disclosure.
Figure 5:
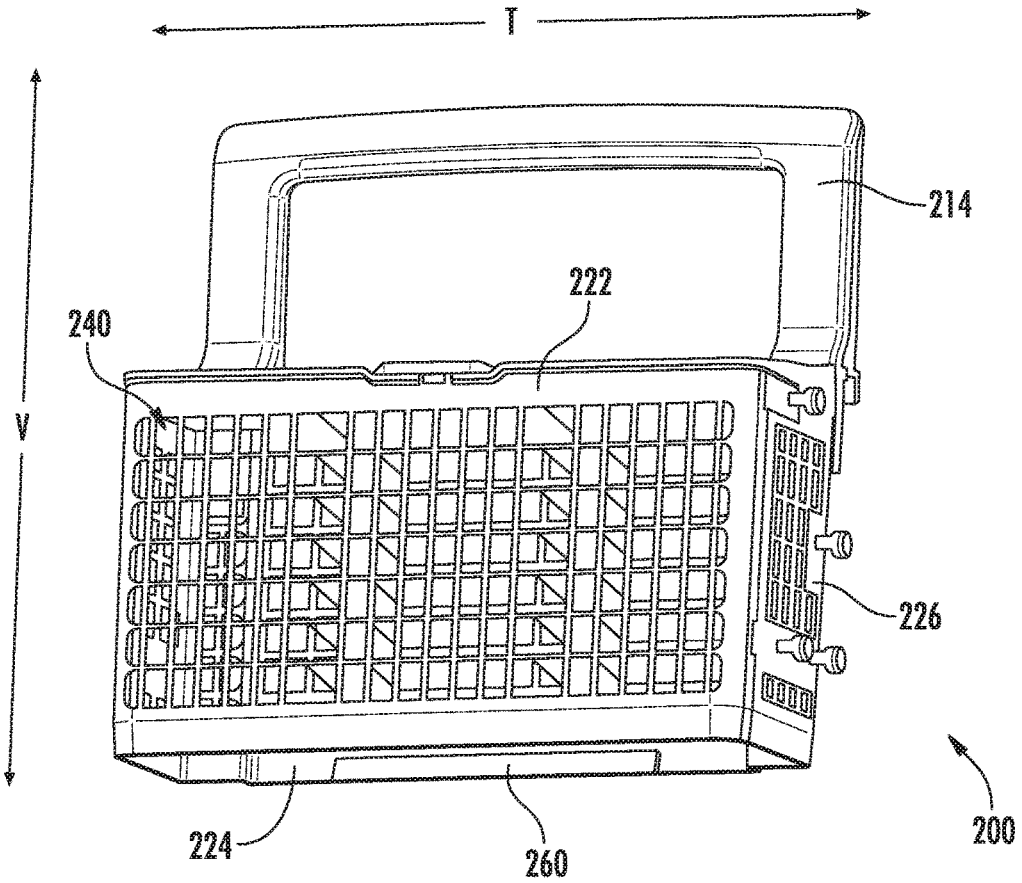
FIG. 5 provides a bottom perspective view of a basket in accordance with embodiments of the present disclosure.

Referring now to FIGS. 3-5, a basket 200 is provided in accordance with embodiments of the present disclosure. It should be appreciated that the basket 200 may be used in place of the basket 170 described above with reference to FIG. 2. As shown, the basket 200 may extend between a first side 202 and a second side 204 e.g., along the transverse direction T. The basket 200 may further extend between a top 206 and a bottom 208 along the vertical direction V. The basket 200 may also extend between a front 210 and a back 212 e.g., along the lateral direction L. Optionally, the basket 200 may include a handle 214 extending e.g., in the vertical direction V, from the top 206 for convenient removal from and/or insertion into a rack assembly, such as the upper and lower rack assemblies 120, 122 described above with reference to FIG. 2.

The basket 200 includes a bottom wall 220. A front wall 222 extends from the bottom wall 220 along the vertical direction V. Similarly, a rear wall 224 extends from the bottom wall 220 along the vertical direction V. As shown, the rear wall 224 may be spaced apart from the front wall 220 along the lateral direction L. The basket 200 may also include a pair of opposing side walls 226 spaced apart from one another along the transverse direction T. Further, each sidewall of the pair of sidewalls 226 may extend between the front and back walls 222, 224 along the lateral direction L. The bottom wall 220, front wall 222, rear wall 224, and opposing sidewalls 226 collectively define a storage chamber 230 configured for receipt of articles (e.g., forks, knives, spoons, and/or utensils).

As shown, the bottom wall 220, front wall 222, rear wall 224, and opposing side walls 226 each define a plurality of apertures 240. The plurality of apertures 240 may permit wash fluid to flow into and out of the cavity 230, e.g., during operation of the dishwasher appliance 100. Additionally, the plurality of apertures 240 may permit a flow of air through the storage chamber 230 e.g., to assist in drying articles therein.

The basket 200 may also include a cover 250 movable between an open position (FIG. 3) and a closed position (FIG. 5). In the open position, the cover 250 may permit access to the storage chamber 230. Conversely, access to the storage chamber 230 may be prohibited when the cover 250 is in the closed position. However, in some embodiments, the cover 250 may define a plurality of apertures 252 that permit an article to be inserted into the storage chamber 230 even when the cover 250 is in the closed position.

The basket 200 may also include one or more magnet(s) 260. The magnet 260 may be positioned at any suitable location on the basket 200. As an example, the magnet 260 may be positioned on the rear wall 224 of the basket 200. As will be discussed below in more detail, the magnet 260 may exert a magnetic bias on a rack assembly to assist in positioning and mounting of the basket 200 within the rack assembly.

Figure 6:
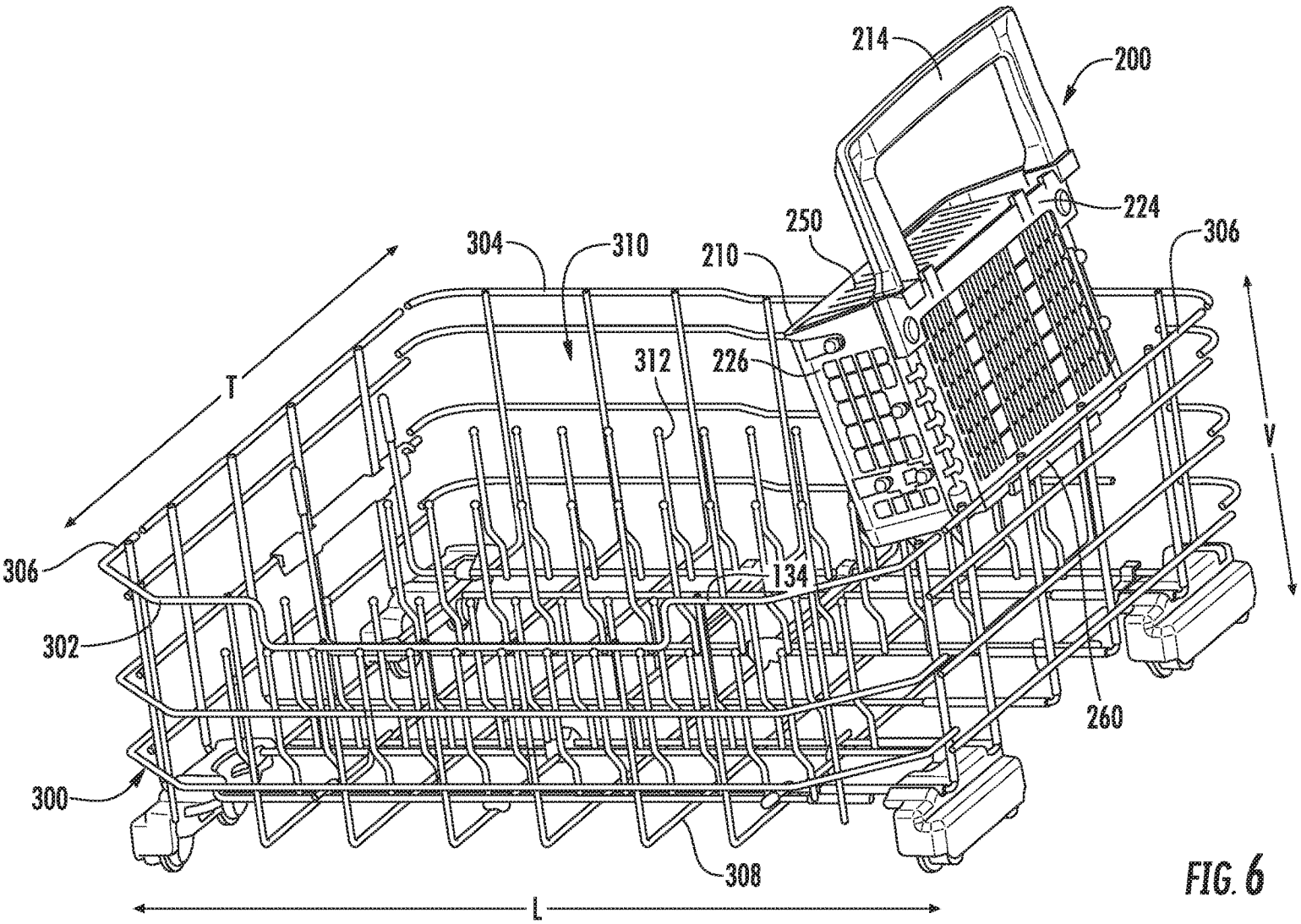
FIG. 6 provides a perspective view of a basket being positioned within a wash compartment of a rack assembly in accordance with embodiments of the present disclosure.
Figure 7:
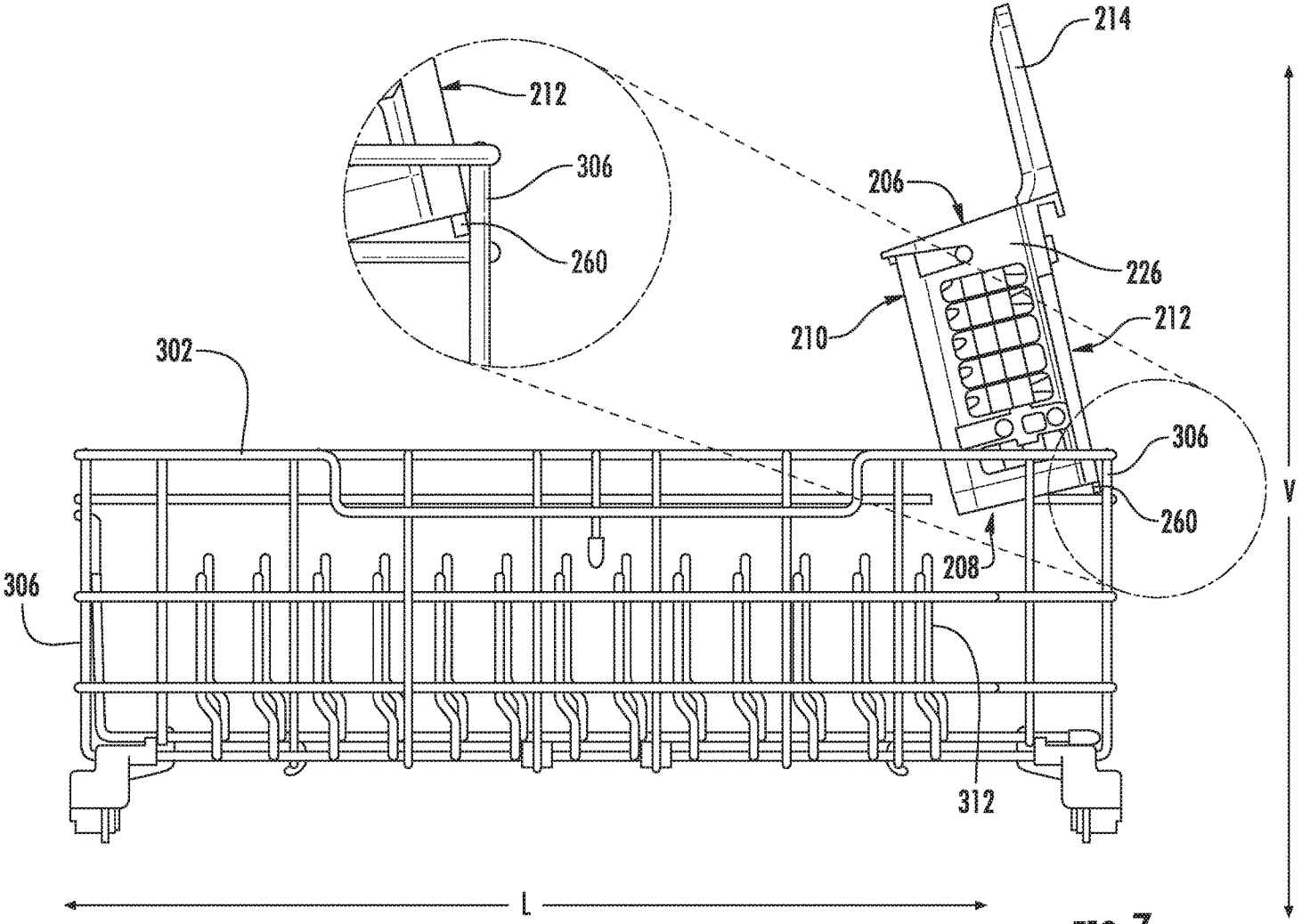
FIG. 7 provides a front view of the basket depicted in FIG. 6.

Referring now to FIGS. 6 and 7, an embodiment of a rack assembly 300 is provided in accordance with embodiments of the present disclosure. It should be appreciated that the rack assembly 300 may be used in place of the rack assemblies 120, 122 described above with reference to FIG. 2. As shown, the rack assembly 300 extends between a front 302 and a rear 304 along the transverse direction T. The rack assembly 300 may also extend between a pair of opposing sides 306 along the lateral direction L. The rack assembly 300 may also include a bottom 308 that extends between the front 302 and rear 304 along the transverse direction T, and between the pair of opposing sides 306 along the lateral direction L. Further, the front 302, rear 304, opposing sides 306, and bottom 308 may collectively define a wash compartment 310 into which the basket 200 may be received. Further, the rack assembly 300 may include a plurality of elongated members 312 positioned within the wash compartment 310. In particular, the plurality of elongated members 312 may extend from the bottom 308 along the vertical direction V. It should be appreciated that the rack assembly 300 may be comprised of a ferromagnetic material. For example, in some embodiments, the rack assembly 300 may be comprised of stainless steel.

As the basket 200 is lowered into the wash compartment 310 of the rack assembly 300, the magnet 260 may exert a magnetic bias on the rack assembly 300. In this respect, the basket 200 may be removably mounted to the rack assembly 300 via the magnet 260. As an example, the magnet 260 may exert a magnetic bias on one of the sides 306 of the rack assembly 300. Accordingly, the basket 200 may move towards the side 306 until the magnet 260 contacts the side 306. Once the magnet 260 contacts the side 306, it should be appreciated that the bottom 208 of the basket 200 may be spaced apart from the bottom 308 of the rack assembly 300 along the vertical direction V. However, since the magnet 260 continues to exert the magnetic bias on the side 306 of rack assembly 300, the basket 200 may remain mounted to the rack assembly 300 as it moves along the vertical direction V towards the bottom 308 of the rack assembly 300. Further, the magnet 260 may restrain movement of the basket 200 throughout operation of the dishwasher appliance 100 (FIG. 1). This advantageously prevents the basket 200 from tipping over and allowing silverware or other items within the storage chamber 230 to become dispersed within the wash chamber 106 (FIG. 2).

It should be appreciated that the magnet 260 may be used to mount the basket 200 at any suitable location on the rack assembly 300. For example, the basket 200 may be mounted to the front 302 of the rack assembly 300. Alternatively, the basket 200 may be mounted to the rear 304 of the rack assembly 300.

Figure 8:
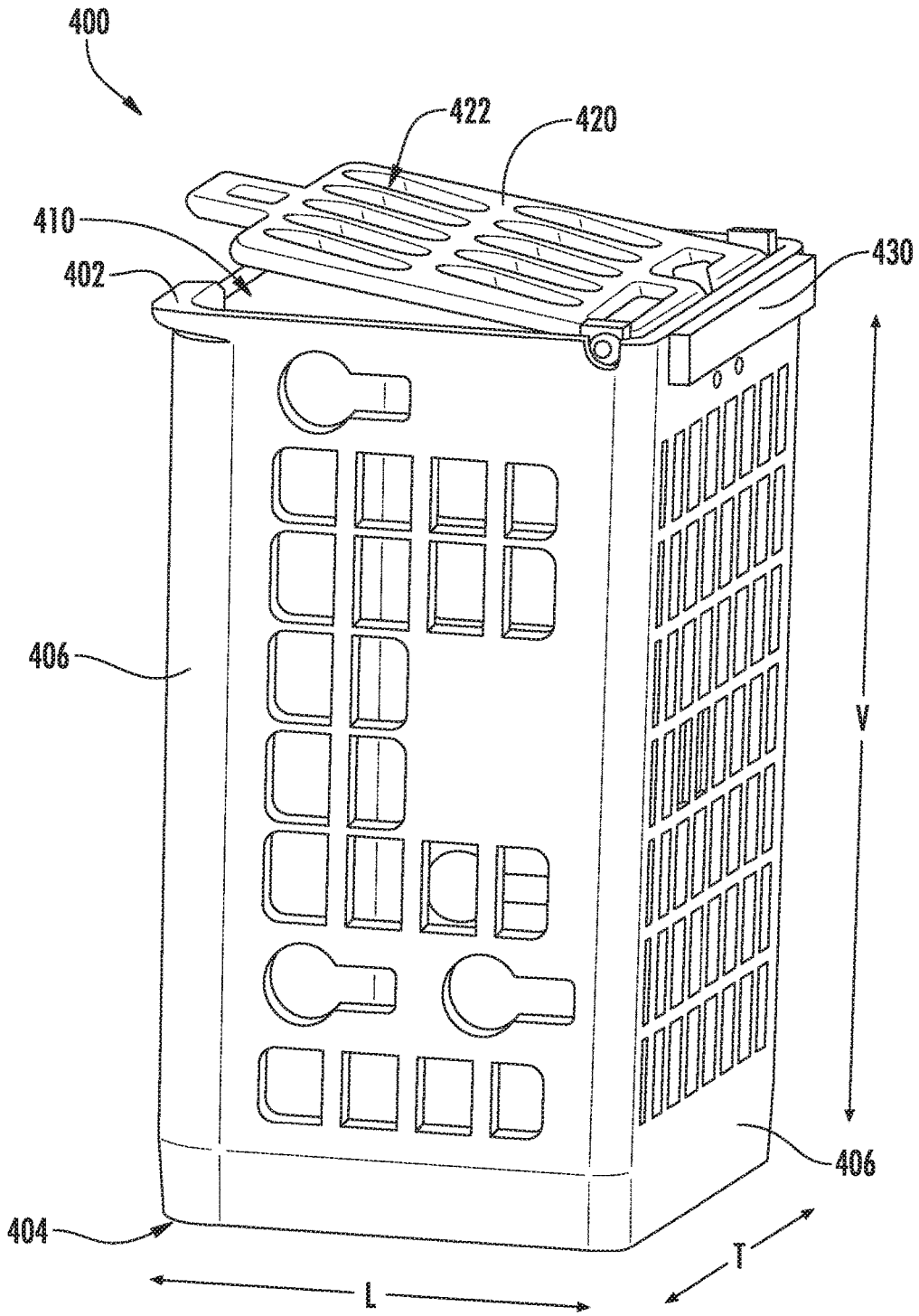
FIG. 8 provides a perspective view of another basket in accordance with embodiments of the present disclosure.
Figure 9:
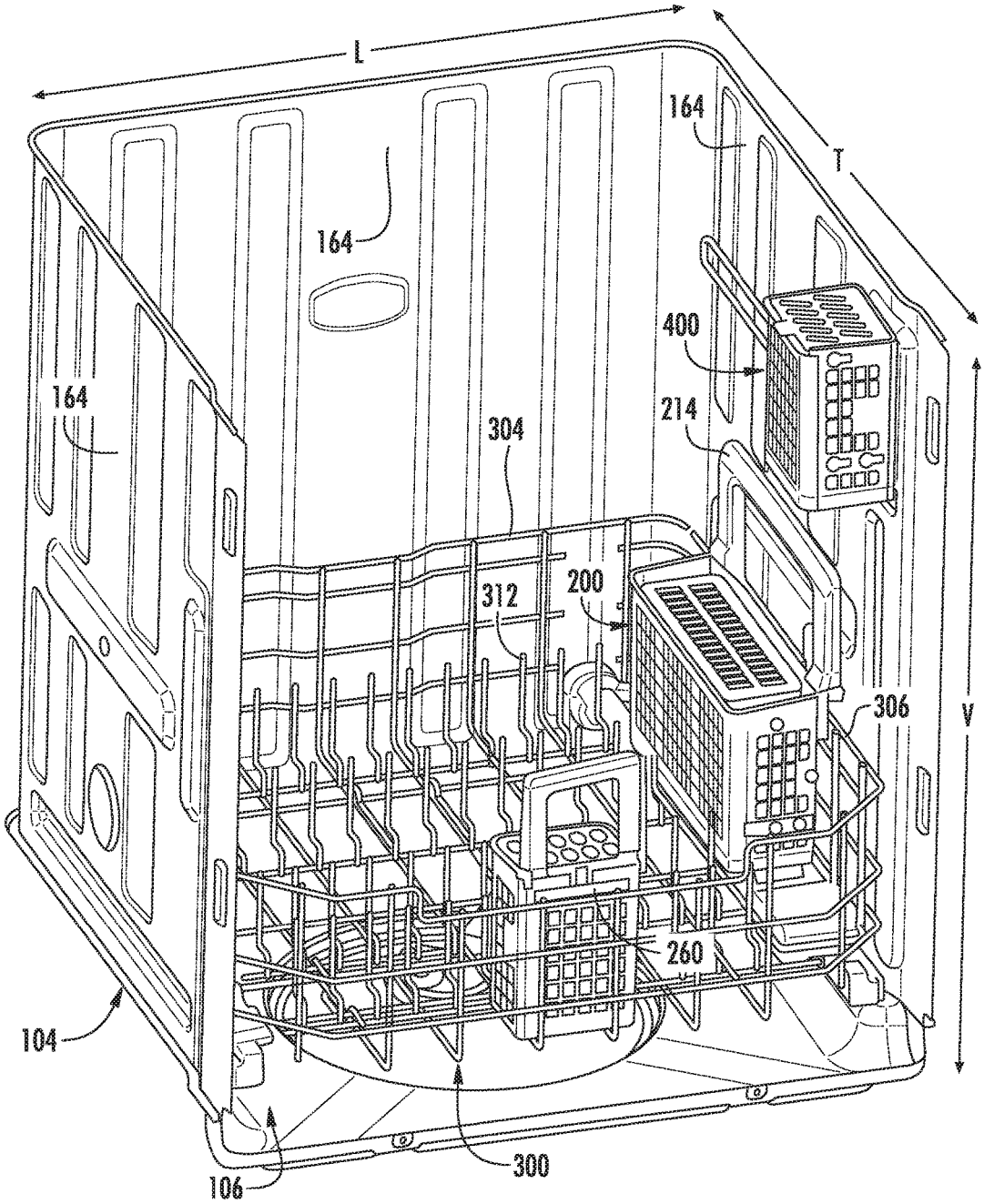
FIG. 9 provides a perspective view of a basket mounted to a tub of a dishwasher appliance in accordance with embodiments of the present disclosure.

Referring now to FIGS. 8 and 9, another embodiment of a basket 400 is provided in accordance with embodiments of the present disclosure. The basket 400 includes a top 402 and a bottom 404 that is spaced apart from the top 402 along the vertical direction V. The basket 400 further includes a plurality of sidewalls 406 that extend between the top 402 and bottom 404 along the vertical direction V. The top 402, bottom 404, and plurality of sidewalls 406 collectively define a storage chamber 410 configured to store articles, such as silverware or any other suitable kitchen utensil.

The basket 400 may also include a cover 420 movable between an open position (FIG. 8) and a closed position (FIG. 9). In the open position, the cover 420 may permit access to the storage chamber 410. Conversely, access to the storage chamber 410 may be prohibited when the cover 420 is in the closed position. However, in some embodiments, the cover 420 may define a plurality of apertures 422 that permit an article to be inserted into the storage chamber 410 even when the cover 420 is in the closed position.

The basket 400 may also include one or more magnets 430. The magnet 430 may be positioned at any suitable location on the basket 400. As an example, the magnet 430 may be positioned on one of the sidewalls 406 of the basket 400. As will be discussed below in more detail, the magnet 430 may exert a magnetic bias on the tub 104 to assist in positioning and mounting of the basket 400 within the wash chamber 106.

When the basket 400 is positioned within the wash chamber 106, the magnet 430 may exert a magnetic bias on the tub 104. In this respect, the basket 400 may be removably mounted to the tub 104 via the magnet 430. As an example, the magnet 430 may exert a magnetic bias on one of the plurality of sidewalls 164 of the tub 104. Further, the basket 400 may move towards the sidewall 164 until the magnet 430 contacts the sidewall 164. When the magnet 430 contacts the sidewall 164, it should be appreciated that the magnet 430 is positioned between the sidewalls 164, 406 of the tub 104 and basket 400, respectively. Further, the magnet 430 may restrain movement of the basket 400 throughout operation of the dishwasher appliance 100 (FIG. 1). This advantageously allows the basket 400 to be positioned outside of the upper and lower rack assemblies 120, 122.

Figure 10:
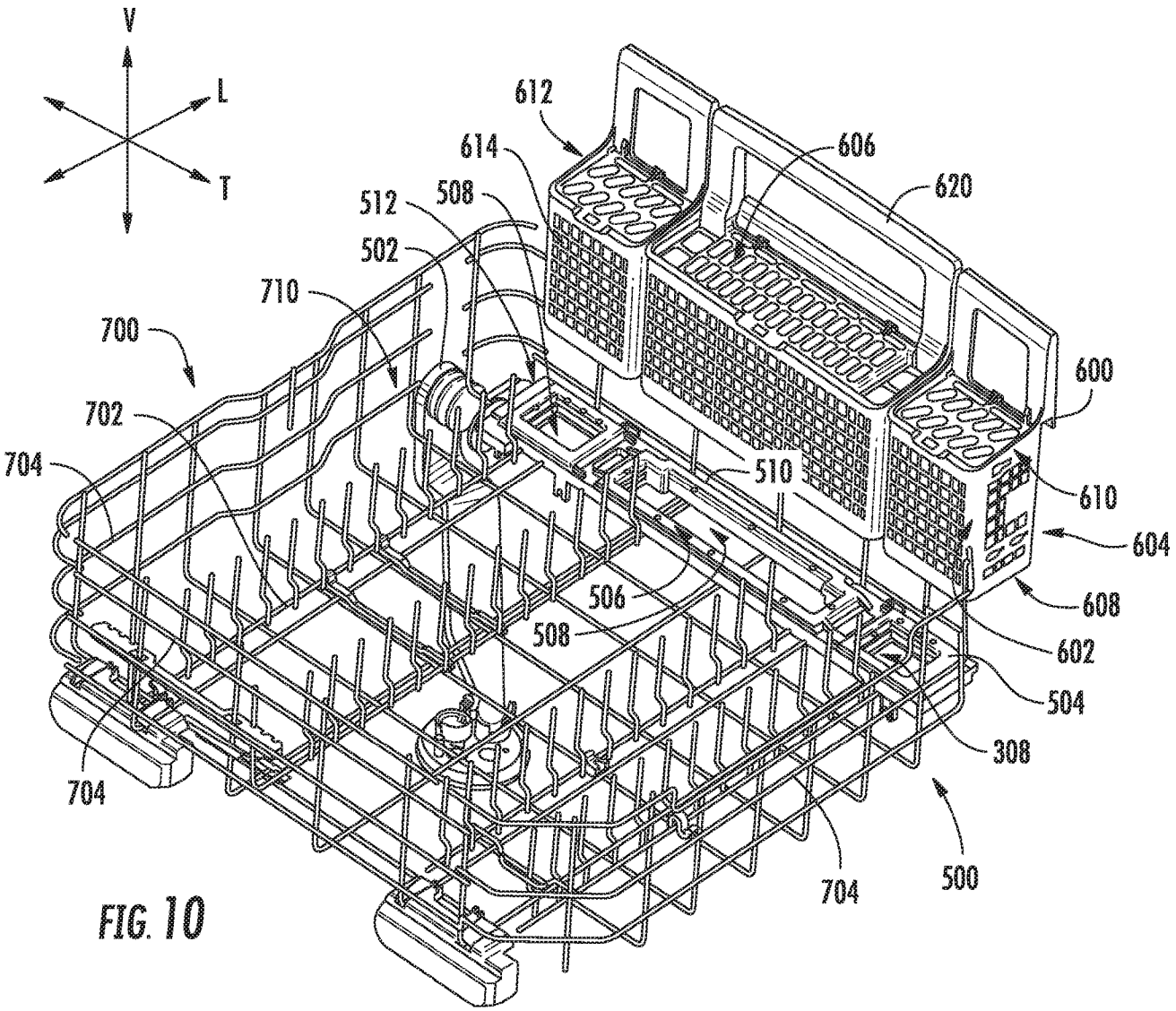
FIG. 10 provides an exploded perspective view of several components of a dishwasher appliance, including a static jet assembly, a basket, and a rack assembly.

Referring now to FIG. 10, the dishwasher appliance 100 (FIG. 2) may include a static jet assembly 500. As shown, the static jet assembly 500 may include a fluid conduit 502 and static body 504 in selective fluid communication with the pump 142 (FIG. 2). In some embodiments, a basket 600 is positioned and/or mounted proximate to the static jet assembly 500. As illustrated, the basket 600 extends between a front 602 and a rear 604 along the lateral direction L. The basket 600 also extends between a top 606 and a bottom 608 along the vertical direction V. The basket 600 further extends between a first side 610 and a second side 612 along the transverse direction T. Apertures 614 may be defined between one or all of the areas between the front 602 and back 604, the top 606 and bottom 608, or the first and second sides 610, 612. Optionally, the basket 600 may include a handle 620 extending, e.g., in the vertical direction V, from the top 606 for convenient removal from and/or insertion into a rack assembly.

The static jet assembly 500 includes a static body 504 defining an interior passage 506 to direct wash fluid from the fluid conduit 502. The static body 504 may include an upper face 510 that defines a plurality of jet apertures 512. Optionally, the static body 504 may extend about one or more exterior holes 508. The jet apertures 512 may be in fluid communication between the interior passage 506 and the wash chamber 106 (FIG. 2). During use, wash fluid may thus be directed into the wash chamber 106 from the jet apertures 512, e.g., after passing into the interior passage 506 from the fluid conduit 502.

In some embodiments, at least a portion of the static jet assembly 500, e.g., the static body 504 is mounted to a rack assembly 700. It should be noted that the rack assembly 700 may be embodied as a lower rack assembly 122 or an upper rack assembly 120, as illustrated in FIG. 2. In turn, in some embodiments wherein the rack assembly 700 is a lower rack assembly 122, the upper rack assembly 120 will be disposed above the rack assembly 700 along the vertical direction V.

The rack assembly 700 may generally include a bottom wall 702 and a plurality of side walls 704 defining a wash compartment 710 for receiving articles to be washed. Each wall 702, 704 may be formed from a lattice structure, as described above. Optionally, the wash compartment 710 may receive the basket 600 therein. Additionally or alternatively, the wash compartment 710 may receive the static body 504. For instance, the static body 504 may be mounted to one or more of the walls 702, 704 within the wash compartment 710 such that the jet apertures 512 are directed, e.g., in the vertical direction V, into a portion of the wash compartment 710.

In some embodiments, the jet apertures 512 may be directed to spray wash fluid into a storage chamber defined by the basket 600 that is positioned on the upper face of the static body 504. This may advantageously provide more efficient cleaning of silverware and/or other items positioned within the storage chamber of the basket 600. However, the pressure of the wash fluid exiting the jet apertures 512 may cause the basket 600 to become dislodged from the static body 504 during operation of the dishwasher appliance 100. As will be discussed below in more detail, the basket 600 may be mounted to the static body 504 via one or more magnets to ensure the basket 600 remains positioned on the static body 504 throughout the operation of the dishwasher appliance 100.

Figure 11:
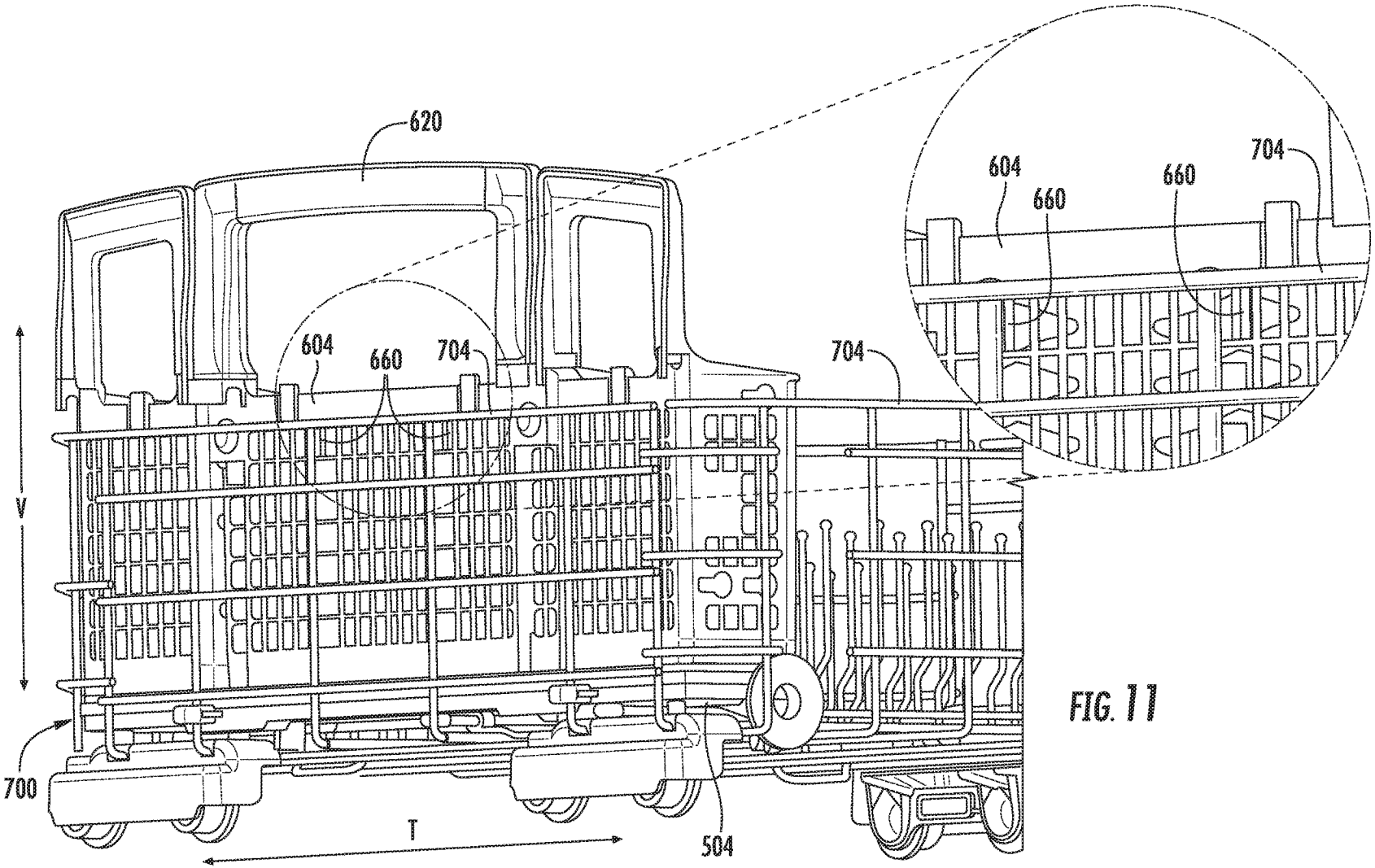
FIG. 11 provides a side view of a basket mounted to a static jet assembly in accordance with embodiments of the present disclosure.

Referring now to FIG. 11, the basket 600 may include one or more magnet(s) 660. In particular, the basket 600 may include a pair of magnets 660 spaced apart from one another along the transverse direction T. The pair of magnet 660 may be positioned at any suitable location on the basket 600. As an example, the pair of magnets 660 may be positioned on the rear 604 of the basket 600. As will be discussed below in more detail, the magnets 660 may exert a magnetic bias on the rack assembly 700 to assist in positioning the basket 600 on the static body 504.

As the basket 600 is lowered into the wash compartment 710, the magnets 660 may exert a magnetic bias on the rack assembly 700. In this respect, the basket 600 may be removably mounted to the rack assembly 700 via the magnets 660. As an example, the magnets 660 may exert a magnetic bias on one of the side walls 704 of the rack assembly 700. Accordingly, the basket 600 may move towards the sidewall 704 until the magnets 660 contact the sidewall 704. Once the magnets 660 contact the sidewall 704, it should be appreciated that the bottom 608 of the basket 600 may be spaced apart from the static body 504 along the vertical direction V. However, since the magnets 660 continue to exert the magnetic bias on the side wall 704, the basket 600 may remain mounted to the rack assembly 700 as it moves along the vertical direction V towards the upper face 510 of the static body 504. Further, the magnets 660 may restrain movement of the basket 600 throughout operation of the dishwasher appliance 100 (FIG. 1). This advantageously allows the basket 600 to remain positioned on the static body 504 during operation of the static jet assembly 500.

Figure 12:
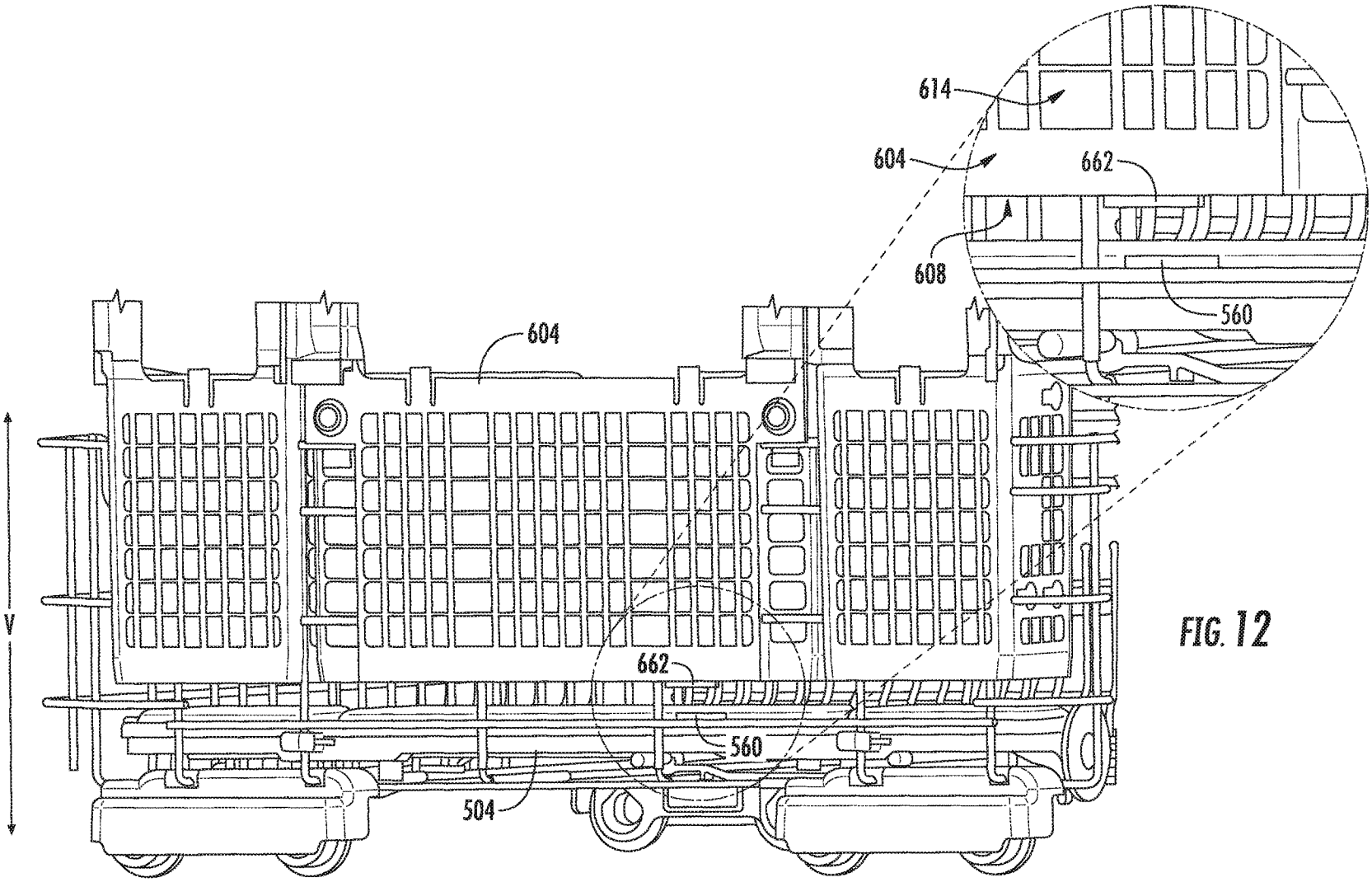
FIG. 12 provides a side view of another basket mounted to a static jet assembly in accordance with embodiments of the present disclosure.

Referring now to FIG. 12, a magnet 662 may additionally or alternatively be positioned on the bottom 608 of the basket 600. Further, the static body 504 may include one or more magnets 560. More specifically, the magnet 560 may be positioned on the upper face 510 of the static body 504. As will be discussed below in more detail, the magnets 560, 662 may contact one another to restrain or limit movement of the basket 600.

As the basket 600 is lowered into the wash compartment 710, the magnet 560 on the static body 504 may exert a magnetic bias on the magnet 662 positioned on the bottom 608 of the basket 600. In this respect, the basket 600 may be removably mounted to the static body 504 via the magnets 560, 662. As the magnetic bias exerted on the magnet 662 increases, the basket 600 moves closer towards the static body 504 along the vertical direction V. In particular, the basket 600 moves along the vertical direction V until the magnet 662 on the bottom 608 of the basket 600 contacts the magnet 560 on the upper surface 510 of the static body 504.

Once the magnets 560, 662 contact one another, the basket 600 is mounted to the upper surface 510 of the static body 560. The magnets 560, 662 remain in contact with one another to restrain movement of the basket 600 during operation of the static jet assembly 500. This advantageously allows the basket 600 to remain positioned on the static body 504 despite the high pressure of the wash fluid exiting the jet apertures 512.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance comprising:

a tub defining a lateral direction, a transverse direction, and a vertical direction, the tub further defining a wash chamber;

a rack assembly disposed within the wash chamber, the rack assembly defining a wash compartment; and a silverware basket disposed within the wash compartment, the silverware basket comprising:

a bottom wall;

a front wall extending from the bottom wall along the vertical direction;

a rear wall spaced apart from the front wall along the lateral direction, the rear wall extending from the bottom wall along the vertical direction;

a first sidewall extending from the bottom wall along the vertical direction, the first sidewall further extending between the front wall and the rear wall along the lateral direction;

a second sidewall extending from the bottom wall along the vertical direction and spaced apart from the first sidewall along the transverse direction, the second sidewall extending between the front wall and the rear wall along the lateral direction; and a magnet disposed on the rear wall of the silverware basket such that the magnet is positioned between the bottom wall of the silverware basket and a bottom of the rack assembly, wherein the silverware basket is removably mounted to the rack assembly via the magnet.

2. The dishwasher appliance of claim 1, wherein the magnet comprises a first magnet and a second magnet spaced apart from the first magnet along the transverse direction.

3. The dishwasher appliance of claim 1, wherein:

the rack assembly extends along the transverse direction between a front of the rack assembly and a rear of the rack assembly, along the lateral direction between a first side of the rack assembly and a second side of the rack assembly; and wherein the silverware basket is removably mounted to the first side of the rack assembly via the magnet.

* * * * *